United States Patent [19]

Vanier et al.

[11] Patent Number: 4,700,208

[45] Date of Patent: Oct. 13, 1987

[54] DYE-BARRIER/SUBBING LAYER FOR DYE-DONOR ELEMENT USED IN THERMAL DYE TRANSFER

[75] Inventors: Noel R. Vanier, Rochester; Kin K. Lum, Webster; Wayne A. Bowman, Walworth, all of N.Y.

[73] Assignee: Eastman Kodak Company, Rochester, N.Y.

[21] Appl. No.: 934,968

[22] Filed: Nov. 25, 1986

Related U.S. Application Data

[63] Continuation-in-part of Ser. No. 813,294, Dec. 24, 1985, abandoned.

[51] Int. Cl.[4] ..... B41M 5/26

[52] U.S. Cl. ..... 503/227; 8/471; 427/146; 427/256; 428/195; 428/341; 428/478.2; 428/480; 428/483; 428/522; 428/704; 428/913; 428/914

[58] Field of Search ..... 8/470, 471; 346/227; 427/146, 256; 428/195, 207, 341, 342, 478.2, 478.4, 478.8, 480, 483, 484, 488.1, 488.4, 522, 704, 913, 914; 430/945

[56] References Cited

U.S. PATENT DOCUMENTS

| | | | |
|---|---|---|---|
| 4,021,591 | 5/1977 | DeVries et al. | 428/914 |
| 4,027,345 | 6/1977 | Fujisawa et al. | 428/913 |
| 4,253,838 | 3/1981 | Mizuno et al. | 8/471 |

FOREIGN PATENT DOCUMENTS

| | | | |
|---|---|---|---|
| 109295 | 5/1984 | European Pat. Off. | 8/471 |
| 138483 | 4/1985 | European Pat. Off. . | |
| 19138 | 1/1985 | Japan | 346/227 |

*Primary Examiner*—Bruce H. Hess
*Attorney, Agent, or Firm*—Harold E. Cole

[57] ABSTRACT

A dye-donor element for thermal dye transfer comprises a support, a hydrophilic dye-barrier/subbing layer comprising poly(butyl acrylate-co-2-aminoethyl methacrylate-co-2-hydroxyethyl methacrylate), poly(N-isopropylacrylamide-co-2-aminoethyl)-methacrylate-co-(2-hydroxyethyl methacrylate), poly[(2-chloroethyl)acrylamide-co-ethacrylic acid],or gelatin nitrate and a dye layer. The dye-barrier/subbing layer provides improved dye transfer densities.

17 Claims, No Drawings

DYE-BARRIER/SUBBING LAYER FOR DYE-DONOR ELEMENT USED IN THERMAL DYE TRANSFER

This application is a continuation-in-part of U.S. Application Ser. No. 813,294, filed Dec. 24, 1985, now abandoned.

This invention relates to dye-donor elements used in thermal dye transfer, and more particularly to the use of dye-barrier/subbing layers to provide improved dye transfer densities.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magneta and yellow signals. The process is then repeated for the other two colors. A color hard copy is thus obtained which corresponds to the original picture viewed on a screen. Further details of this process and an apparatus for carrying it out are contained in U.S. Ser. No. 778,960 by Brownstein entitled "Apparatus and Method For Controlling A Thermal Printer Apparatus," filed Sept. 23, 1985, the disclosure of which is hereby incorporated by reference.

Dye layers which are coated directly on a support for a dye-donor element for thermal dye transfer printing, such as poly(ethylene terephthalate), experience loss of dye by uncontrolled non-directionalized diffusion into the support during the transfer process. The dye-donor support softens during heating and has the inherent property to act as a receiver for the dye. Dye which is lost by this wrong way diffusion results in less dye being transferred to the dye-receiving element. Since the background density in a thermal dye transfer system is essentially constant, any increase in density of the transferred dye in image areas results in improved discrimination, which is highly desirable.

In Japanese patent publication number 19,138/85, an image-receiving element for thermal dye transfer printing is disclosed. In Example 3 of that publication, a dye-donor element is also described which indicates that a gelatin subbing layer of 2 g/m$^2$ is located between the dye layer and the support. It would be desirable to increase the dye density obtained by such elements.

In European Patent Application No. 109,295, there is a disclosure of a dye-donor sheet with a "prime coating" thereon such as a polycarbonate or a polyester. These prime coatings are hydrophobic materials and are said to melt when the sheet is heated. Since most dyes used for thermal printing are also hydrophobic, they would readily diffuse into such a layer, so that the dye available for transfer would decrease.

Another requirement for dye-donor elements used in thermal dye transfer is the obtaining of adequate adhesion between the dye layer and the support. A separate subbing layer is usually employed.

It would be desirable to eliminate the need for a separate subbing layer in a dye-donor element. It would also be desirable to provide a way to increase the density of the transferred dyes.

These and other objects are achieved by employing a dye-barrier/subbing layer in accordance with this invention.

Thus, this invention relates to a dye-donor element for thermal dye transfer which comprises a support having thereon a dye layer, and wherein a hydrophilic dye-barrier/subbing layer is located between the dye layer and the support, the dye-barrier/subbing layer comprising poly(butyl acrylate-co-2-aminoethyl methacrylate-co-2-hydroxyethyl methacrylate), poly(N-isopropylacrylamide-co-2-aminoethyl)-methacrylate-co-(2-hydroxyethyl methacrylate), poly[(2-chloroethyl)acrylamide-co-methacrylic acid], or gelatin nitrate. The weight ratios of the components in the acrylic polymers can vary widely and is not critical.

In a preferred embodiment of the invention, the dye-barrier/subbing layer is present in an amount of up to about 1.8 g/m$^2$.

In another preferred embodiment of the invention, the dye-barrier/subbing layer comprises gelatin nitrate. This material is obtained by coating a mixture of gelatin, cellulose nitrate, and salicyclic acid (20:5:2 wt. ratio) in a solvent primarily of acetone, methanol and water.

The hydrophilic polymers described above which are used in the invention function as a dye-barrier layer since most of the dyes used in thermal dye transfer printing are hydrophobic, as noted above, and they have negligible affinity for or solubility in hydrophilic materials. Thus, the barrier layer functions to prevent wrong-way transfer of dye into the donor support, with the result that the density of the transferred dye is increased.

The hydrophilic polymers described above which are used in the invention also have adequate adhesion to the support and the dye layer, thus eliminating the need for a separate subbing layer. The particular hydrophilic polymers described above used in a single layer in the donor element thus perform a dual function, hence are referred to as dye-barrier/subbing layers.

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

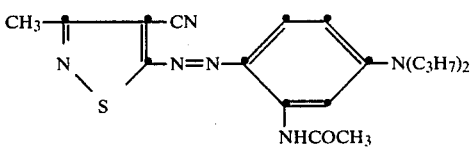

(magenta)

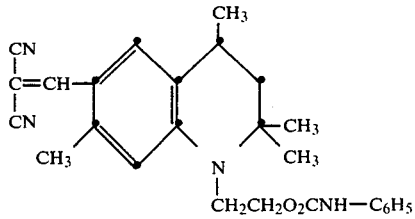

(yellow)

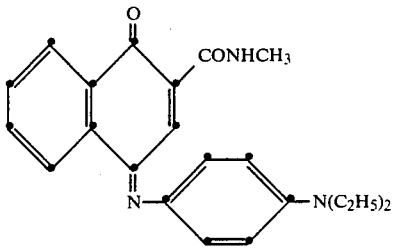

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyether-imides. The support generally has a thickness of from about 2 to about 30 $\mu$m.

The reverse side of the dye-donor element may be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating material include oils or semi-crystalline organic solids that melt below 100° C. such as poly(vinyl stearate), beeswax, perfluorinated alkyl ester polyethers, poly(caprolactone), carbowax or poly(ethylene glycols). Suitable polymeric binders for the slipping layer include poly(vinyl alcohol butyral), poly(vinyl alcohol acetal), poly(styrene), poly(vinyl acetate), cellulose acetate butyrate, cellulose acetate, or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as barytacoated paper, white polyester (polyester with white pigment incorporated therein), an ivory paper, a condenser paper or a synthetic paper such as duPont Tyvek®. In a preferred embodiment, polyester with a white pigment incorporated therein is employed.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye-donor element of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only one dye thereon or may have alternating areas of different dyes, such as sublimable cyan, magenta, yellow, black, etc., as described in U.S. Pat. No. 4,541,830. Thus, one-, two- three- or four-color elements (or higher numbers also) are included within the scope of the invention.

In a preferred embodiment of the invention, the dye-donor element comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCSOO1), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1

(A) A dye-donor element according to the invention was prepared by coating the following layers in the order recited on a 6 μm poly(ethylene terephthalate) support:

(1) Dye-barrier/subbing layer of gelatin nitrate (gelatin, cellulose nitrate and salicyclic acid in approximately 20:5:2 weight ratio in a solvent of acetone, methanol and water) having the coverage indicated in Table 1, and (2) Dye layer containing the following magenta dye (0.15 g/m$^2$) in a binder of 0.15 g/m$^2$ 2-ethyl-2-hydroxymethyl-1,3-propanediol and 0.54 g/m$^2$ high viscosity cellulose acetate coated from tetrahydrofuran:

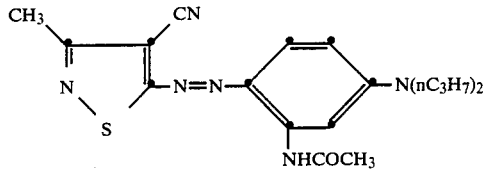

(B) A control element was prepared similar to A), except that it had no dye-barrier/subbing layer.

(C) Another dye-donor element was prepared similar to A), except that the dye layer consisted of 0.22 g/m$^2$ magenta dye and 0.39 g/m$^2$ cellulose acetate hydrogen phthalate (18% to 21% acetyl, 32%–36% phthlyl) coated from 8% cyclohexanone and 11% acetone in 2-butanone.

(D) Another control element was prepared similar to (C), except that it had no dye-barrier/subbing layer.

Dye-receiving elements

For donor elements A and B, the dye-receiving element consisted of a reflective paper support having a waterproof poly(ethylene)-titanium dioxide overcoat which was coated with a dye image-receiving layer comprising 4.8 g/m$^2$ of Uralac P-2504 ® (GCA Chemical Corporation) hydroxylated branched polyester resin.

For donor elements C) and D), 2.9 g/m$^2$ of Makrolon 5705 ® (Bayer AG) polycarbonate resin was coated on top of ICI Melinex 990 ® white polyester support from a dichloromethane and trichloroethylene solvent mixture.

The dye side of the dye-donor element strip 0.75 inches (19 mm) wide was placed in contact with the dye image-receiving layer of the dye-receiver element of the same width. The assemblage was fastened in the jaws of a stepper motor driven pulling device. The assemblage was laid on top of a 0.55 (14 mm) diameter rubber roller and a Fujitsu Thermal Head and was pressed with a spring at a force of 3.5 pounds (1.6 kg) against the dye-donor element side of the assemblage pushing it against the rubber roller.

The image electronics were activated causing the pulling device to draw the assemblage between the printing head and roller at 0.123 inches/sec (3.1 mm/sec). Coincidentally, the resistive elements in the thermal print head were heated at 0.5 msec increments from 0 to 4.5 msec to generate a graduated density test pattern. The voltage supplied to the print head was approximately 19 v representing approximately 1.75 watts/dot. Estimated head temperature was 250°–400° C.

The assemblage was separated, the dye-donor element was discarded, and the dye transferred to the dye-receiver element was measured with an X-Rite 338 Color Reflection Densitomer ® with Status A filters. The following results were obtained:

TABLE 1

| Element | Barrier/Subbing Layer (g/m$^2$) | Dye Layer Conc. (g/m$^2$) | Receiving Layer | Status A D-max |
|---|---|---|---|---|
| B | None (Control) | 0.15 | Polyester | 0.80 |
| A | Gelatin nitrate A coating composition of gelatin, cellulose nitrate, and salicyclic acid (20:5:2 wt. ratio) in a solvent primarily acetone, methanol, and water (0.47) | 0.15 | Polyester | 0.99 |
| D | None (Control) | 0.22 | Poly-carbonate | 1.9 |
| C | Gelatin nitrate (as A above) (0.43) | 0.22 | Poly-carbonate | 2.1 |

The results indicate that the gelatin nitrate dye-barrier/subbing layer of the invention is effective to significantly increase D-max as compared to the controls without any dye-barrier/subbing layer.

EXAMPLE 2

(A) A dye-donor element according to the invention was prepared by coating the following layers in the order recited on a 6 μm poly(ethylene terephthalate) support:

(1) Dye-barrier layer of poly(butyl acrylate-co-2-aminoethyl methacrylate-co-2-hydroxyethyl methacrylate) (30:10:60 wt. ratio) having the coverage indicated in Tables 2 and 3, and (2) Dye layer containing the following magenta dye (0.17 g/m$^2$) in a cellulose acetate propionate binder (2.5% acetyl, 45% propionyl) (0.34 g/m$^2$) coated from a toluene and methanol (80:20) solvent mixture:

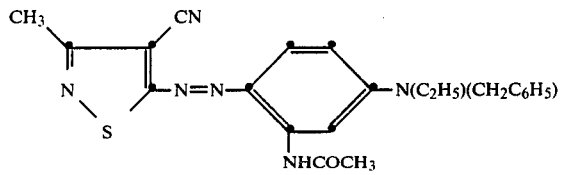

On the back side of the element was coated a slipping layer of Gafac RA600® (GAF Corp.), a complex phosphate mono- and di-ester nonionic surfactant (0.032 g/m$^2$) in a poly(styrene-co-acrylonitrile) (70:30 wt. ratio) binder (0.58 g/m$^2$) coated from a tetrahydrofuran:cyclopentanone (90:10) solvent mixture.

(B) A dye-donor element was prepared similar to (A), except that the barrier/subbing layer was at a 30:20:50 wt. ratio.

(C) A dye-donor element was prepared similar to (A), except that the barrier/subbing layer was at a 48:12:42 wt. ratio.

(D) A dye-donor element was prepared similar to (A), except that the barrier/subbing layer was poly(-N-isopropylacrylamide-co-2-aminoethyl)methacrylate)-co-(2-hydroxyethyl methacrylate) at a 50:5:45 wt. ratio.

(E) A dye-donor element was prepared similar to (D), except that the barrier/subbing layer was at a 70:5:25 wt. ratio.

(F) A dye-donor element was prepared similar to (A), except that the barrier/subbing layer was poly[(2-chloroethyl(acrylamide-co-methacrylic acid] at a 95:5 wt. ratio.

(G) A dye-donor element was prepared similar to (F), except that the barrier/subbing layer was at a 98:2 wt. ratio.

(H) A dye-donor element was prepared similar to (A), except that the barrier/subbing layer was gelatin nitrate.

(I) A control dye-donor element was prepared similar to (A), except that it had no barrier/subbing layer.

(J) A control dye-donor element was prepared similar to (A), except that the barrier/subbing layer was gelatin.

(K) A control dye-donor element was prepared by coating a subbing layer of poly(acrylonitrile-co-vinylidene chloride-co-acrylic acid) (14:80:6 wt. ratio).

A dye-receiving element was prepared by coating a solution of Makrolon 5707® (Bayer AG) polycarbonate resin (2.9 g/m$^2$) and release agent FC-431® (3M Corp.) (40 mg/m$^2$) on an ICI Melinex 990® white polyester support from a methylene chloride and trichloroethylene solvent mixture.

The dye side of the dye-donor element strip one inch (25 mm) wide was placed in contact with the dye image-receiving layer of the dye-receiver element of the same width. The assemblage was fastened in the jaws of a stepper motor driven pulling device. The assemblage was laid on top of a 0.55 (14 mm) diameter rubber roller and a TDK Thermal Head L-133 (No. C6-0242) and was pressed with a spring at a force of 8 pounds (3.6 kg) against the dye-donor element side of the assemblage pushing it against the rubber roller.

The imaging electronics were activated causing the pulling device to draw the assemblage between the printing head and roller at 0.123 inches/sec (3.1 mm/sec). Coincidentally, the resistive elements in the thermal print head were pulse-heated for approximately 8 msec to generate a maximum density image. The voltage supplied to the print head was approximately 22 v representing approximately 1.5 watts/dot (12 mjoules/dot) for maximum power.

The dye-receiver was separated from each dye-donor and the green status A reflection maximum density was read.

Each dye-donor element was also subjected to a tape adhesion test. A small area (approximately ½ inch×2 inches) of 3M Highland® 6200 Permanent Mending Tape was firmly pressed by hand to the top dye layer of a dye-donor element leaving enough area free to serve as a handle for pulling the tape. Upon manually pulling the tape, none of the dye layer with adjacent barrier/subbing layer would be removed in an ideal situation. When dye layer was removed, this indicated a weak bond between the support and the coated layers. An effective subbing layer would prevent such dye layer removal onto the tape as invariably the bonds between the other layers were stronger.

The following categories were established:

E-excellent (no dye layer removal)

G-good (negligible quantities and areas of dye layer removal)

F-fair (small quantities and areas of dye layer removal

P-poor (substantial areas of dye layer removal)

U-unacceptable (dye layer completely removed)

The following results were obtained:

TABLE 2

| Element | Barrier/Subbing Layer @ 0.11 g/m$^2$ | Status A D-max | Tape Test |
|---|---|---|---|
| I (control) | none | 2.4 | P |
| J (control) | gelatin | 2.8 | U |
| K (control) | acrylonitrile polymer | 2.1 | E |
| A | butyl acrylate copolymer 30:10:60 | 2.4 | F |
| B | butyl acrylate copolymer 30:20:50 | 2.4 | F |
| C | butyl acrylate copolymer 48:12:40 | 2.5 | G |
| D | isopropylacrylamide copolymer 50:5:45 | 2.7 | P |
| E | isopropylacrylamide copolymer 70:5:25 | 2.5 | F |
| F | acrylamide copolymer 95:5 | 2.2 | F |
| G | acrylamide copolymer 98:2 | 2.3 | F |
| H | gelatin nitrate | 2.8 | F |

TABLE 3

| Element | Barrier/Subbing Layer @ 0.43 g/m$^2$ | Status A D-max | Tape Test |
|---|---|---|---|
| I (control) | none | 2.4 | P |
| J (control) | gelatin | 2.8 | U |
| K (control) | acrylonitrile polymer | 1.7 | E |
| A | butyl acrylate copolymer 30:10:60 | 1.8 | G |
| B | butyl acrylate copolymer 30:20:50 | 1.7 | F |
| C | butyl acrylate copolymer 48:12:40 | 1.6 | F |
| D | isopropylacrylamide copolymer 50:5:45 | 2.3 | P |
| E | isopropylacrylamide copolymer 70:5:25 | — | — |
| F | acrylamide copolymer 95:5 | 2.3 | F |
| G | acrylamide copolymer 98:2 | 2.3 | F |
| H | gelatin nitrate | 2.4 | F |

The results indicate that the dye-barrier/subbing layers of the invention were generally effective for obtaining good transfer dye density and at least adequate adhesion. Control materials of gelatin and an acrylonitrile copolymer gave undesirable adhesion and dye transfer respectively, when used alone.

The invention has been described in detail with particular reference to preferred embodiments thereof, but it will be understood that variations and modifications can be effected within the spirit and scope of the invention.

What is claimed is:

1. In a dye-donor element for thermal dye transfer comprising a support having thereon a dye layer, the improvement wherein a hydrophilic dye-barrier/subbing layer is located between said dye layer and said support, said dye-barrier/subbing layer comprising poly(butyl acrylate-co-2-aminoethyl methacrylate-co-2-hydroxyethyl methacrylate), poly(N-isopropylacrylamide-co-2-aminoethyl)methacrylate-co-(2-hydroxyethyl methacrylate), poly[(2-chloroethyl)acrylamide-co-methacrylic acid], or gelatin nitrate.

2. The element of claim 1 wherein said dye-barrier/subbing layer is present in an amount of up to about 1.8 $g/m^2$.

3. The element of claim 1 wherein said dye-barrier/subbing layer is gelatin nitrate.

4. The element of claim 1 wherein said dye layer comprises a sublimable dye in a binder.

5. The element of claim 1 wherein the side of the support opposite the side having thereon said dye layer is coated with a slipping layer comprising a lubricating material.

6. The element of claim 1 wherein said support comprises poly(ethylene terephthalate).

7. The element of claim 6 wherein said dye layer comprises sequential repeating areas of cyan, magenta and yellow dye.

8. In a process of forming a dye transfer image comprising imagewise-heating a dye-donor element comprising a support having thereon a dye layer and transferring a dye image to a dye-receiving element to form said dye transfer image, the improvement wherein a hydrophilic dye-barrier/subbing layer is located between said dye layer and said support, said dye-barrier/subbing layer comprising poly(butyl acrylate-co-2-aminoethyl methacrylate-co-2-hydroxyethyl methacrylate), poly(N-isopropylacrylamide-co-2-aminoethyl)-methacrylate-co-(2-hydroxyethyl methacrylate), poly[(2-chloroethyl)acrylamide-co-methacrylic acid], or gelatin nitrate.

9. The process of claim 8 wherein said dye-barrier/subbing layer is present in an amount of up to about 1.8 $g/m^2$.

10. The process of claim 8 wherein said support is poly(ethylene terephthalate) which is coated with sequential repeating areas of cyan, magenta and yellow dye, and said process steps are sequentially performed for each color to obtain a three-color dye transfer image.

11. In a thermal dye transfer assmeblage comprising:

(a) a dye-donor element comprising a support having thereon a dye layer, and (b) a dye-receiving element comprising a support having thereon a dye image-receiving layer, said dye-receiving element being in a superposed relationship with said dye-donor element so that said dye layer is in contact with said dye image-receiving layer, the improvement wherein a hydrophilic dye-barrier/subbing layer is located between said dye layer and said support, said dye-barrier/subbing layer comprising poly(butyl acrylate-co-2-aminoethyl metacrylate-co-2-hydroxyethyl methacrylate), poly(N-isopropylacrylamide-co-2-aminoethyl)metacrylate-co-(2-hydroxyethyl methacrylate), poly[(2-chloroethyl)acrylamide-co-methacrylic acid], or gelatin nitrate.

12. The assemblage of claim 11 wherein said dye-barrier/subbing layer is present in an amount of up to about 1.8 $g/m^2$.

13. The assmeblage of claim 11 wherein said dye-barrier/subbing layer is gelatin nitrate.

14. The assemblage of claim 11 wherein said dye layer comprises a sublimable dye in a binder.

15. The assemblage of claim 11 wherein the side of the support, opposite the side having thereon said dye layer, is coated with a slipping layer comprising a lubricating material.

16. The assemblage of claim 11 wherein said support of the dye-donor element comprises poly(ethylene terephthalate).

17. The assemblage of claim 16 wherein said dye layer comprises sequential repeating areas of cyan, magenta and yellow dye.

* * * * *